United States Patent [19]

Lahr

[11] Patent Number: 5,056,696

[45] Date of Patent: Oct. 15, 1991

[54] BEVERAGE CONTAINER HOLDER

[76] Inventor: Richard Lahr, 10705 Forest Run Dr., Bradenton, Manatee County, Fla. 34202

[21] Appl. No.: 579,693

[22] Filed: Sep. 10, 1990

[51] Int. Cl.[5] ..... A45F 5/00

[52] U.S. Cl. ..... 224/148; 224/253

[58] Field of Search ..... 224/148, 252, 253, 42.45 R, 224/42.43; 248/311.2, 152; 220/85 H; 229/1.5 H

[56] References Cited

U.S. PATENT DOCUMENTS

| | | | |
|---|---|---|---|
| D. 272,775 | 2/1984 | Weissenburger | 224/148 |
| 2,879,023 | 3/1959 | Barrier et al. | 248/311.2 |
| 2,926,879 | 3/1960 | Dietrich | 248/311.2 |
| 4,088,250 | 5/1978 | Schaefer | 220/85 H |
| 4,629,153 | 12/1986 | Marcum | 224/42.45 R |
| 4,708,273 | 11/1987 | Grant | 224/252 |
| 4,856,744 | 8/1989 | Frankel | 248/311.2 |
| 4,865,237 | 9/1989 | Allen | 224/42.45 R |
| 4,893,773 | 1/1990 | Fujimoto | 248/311.2 |

*Primary Examiner*—Linda J. Sholl

*Attorney, Agent, or Firm*—Arthur W. Fisher, III

[57] ABSTRACT

A beverage container holder to retain and support a beverage container therein comprising a single piece body including a lower container support and upper container retainer held in spaced relationship relative to each other by a first and second substantially parallel interconnecting member and an attachment member to attach the beverage container holder to a belt.

38 Claims, 1 Drawing Sheet

BEVERAGE CONTAINER HOLDER

BACKGROUND OF THE INVENTION

1. Field of the Invention

A beverage container holder to retain a beverage container therein including means to attach the beverage container holder to a belt.

2. Description of the Prior Art

Various devices have been designed to support a beverage container on a belt or other similar support means.

U.S. Pat. No. 4,708,273 discloses a holder attached to a person's belt to support an open drink container in an upright position. A lower stop portion carried with the retaining portion engages the bottom of the container in the operative position thereof to support the weight of the container. An intermediate portion can also be provided between the retaining portion and the stop portion to press inwardly against the container and stabilize against substantially lateral forces.

U.S. Pat. No. 4,848,625 shows a holder for carrying a bottle comprising an open cylindrical resilient band having two ends. On one end is adhesive that coacts with the complementary surface of the other end to secure a bottle, therein. A looped protrusion supports the cylindrical band on a person's apparel such as a belt.

U.S. Pat. No. 4,606,523 teaches a cup holder including a cylindrical socket for receiving the lower portion of a drinking cup and a supporting hook adapted to engage the rail of an automobile door.

U.S. Pat. No. 4,808,250 discloses an insulating carrier for containers comprising a receptacle adapted to receive a container including a generally cup-shape open-topped body and an adaptor for mounting the carrier on a support.

U.S. Pat. No. 3,369,723 shows a bottle and flashlight holder and carrier comprising a first elongated bottle-embracing collar, a flap coplanar with and encircled by the collar, the flap having a belt loop, a second bottle embracing elongated collar and a second cap coplanar with and surrounded by the second collar.

U.S. Pat. No. 1,605,195 teaches a flask carrier comprising a receptacle for holding a flask with the neck of the latter upwardly exposed a closed loop at the back of receptacle through which to pass a belt.

SUMMARY OF THE INVENTION

The present invention relates to a beverage container holder to retain and support a beverage container therein to be worn on the belt of the user. More specifically, the beverage container holder comprises a single piece body including a lower container support and an upper container retainer held in spaced relationship relative to each other by a first and second substantially parallel interconnecting members and an attachment member to attach the beverage container holder to the belt of the user.

The beverage container support comprises a substantially flat, circular lower support base having an upwardly extending lip formed about the periphery thereof. The lower portion of each of the first and second substantially parallel interconnecting members is coupled or connected to the upper periphery of the upwardly extending lip by a corresponding flexible lower connecting element; while, the upper container retainer comprises a substantially annular upper retainer ring affixed to the first interconnecting member by a flexible upper connecting element.

The attachment member comprises a belt attachment element extending upwardly from the upper portion of the second interconnecting member having a first pair of substantially vertical belt slots formed on the inner portion thereof and a second pair of substantially vertical belts slots formed on the outer portion thereof in combination with a corresponding horizontal slot permitting access to the pair of second substantially vertical belt slots.

The beverage container holder further includes a securing means to selectively maintain the beverage container holder in a use or erect position. The securing means comprises a first securing element formed in the mid-portion of the belt attachment element to selectively engage a second securing element formed on the substantially annular upper retainer ring to selectively secure the substantially annular upper retainer ring to the belt attachment element to secure the beverage container holder in the use or erect position. Since the first and second securing elements may be selectively disengaged relative to each other, the entire beverage container holder may be stored in a flat position when not in use or held in the erect or use position for use by the user as previously described.

In use, the user simply secures the first and second securing elements in place relative to each other. In this configuration, the user places the beverage container holder on his or her belt through either the first or second pair of substantially vertical belt slots. A beverage container may then be placed through the substantially annular upper retainer ring to rest on the substantially flat, circular lower support base to retain the beverage container therein.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
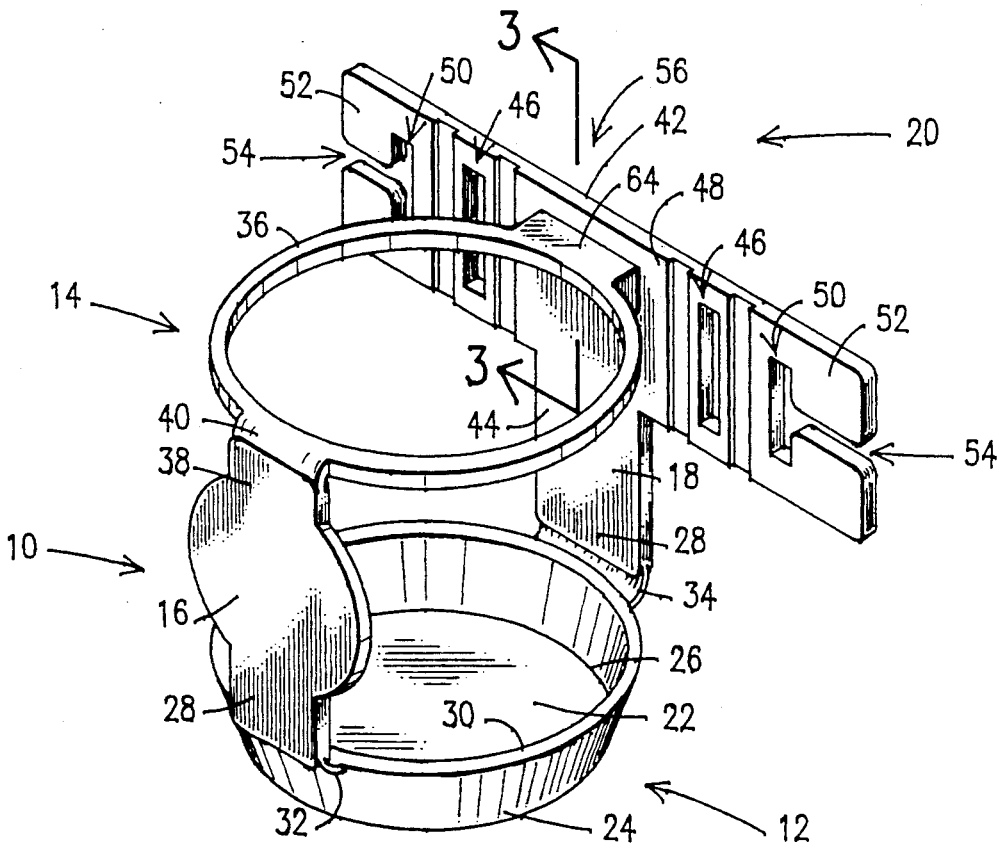
FIG. 1 is a perspective view of the beverage container holder.
Figure 2:
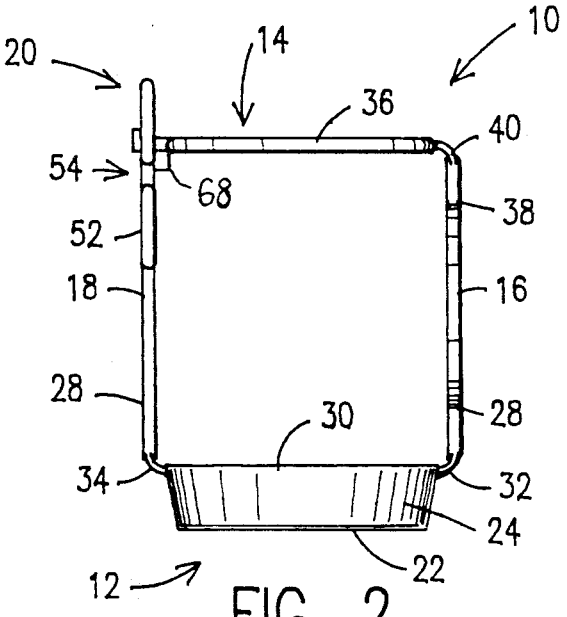
FIG. 2 is a side view of the beverage container holder.

As best shown in FIGS. 1 and 2, the present invention relates to a beverage container holder generally indicated as 10 to retain and support a beverage container (not shown) therein and to be worn on the belt (not shown) of the user. More specifically, the beverage container holder 10 comprises a single piece body including a lower container support generally indicated as 12 and an upper container retainer 14 held in spaced relationship relative to each other by a first and second substantially parallel interconnecting member indicated as 16 and 18 respectively. The beverage container holder 10 further includes an attachment member generally indicated as 20 to attach the beverage container holder 10 to the belt (not shown) of the user.

The lower container support 12 comprises a substantially flat circular lower support base 22 having an upwardly extending lip 24 formed about the periphery 26 thereof. The lower portions 28 of the first and second substantially parallel interconnecting members 16 and 18 are coupled or connected to the upper periphery 30 of the upwardly extending lip 24 by a first and second corresponding flexible lower connecting element indicated as 32 and 34 respectively. The upper container retainer 14 comprises a substantially annular upper retainer ring 36 affixed to the upper portion 38 of the first interconnecting member 16 by a flexible upper connecting element 40.

The attachment member 20 comprises a belt attachment element 42 extending upwardly from the upper portion 44 of the second interconnecting member 18 having a first pair of substantially vertical belt slots each indicated as 46 formed on the inner portion 48 thereof and a second pair of substantially vertical belt slots each indicated as 50 formed on the outer portions 52 thereof in combination with a corresponding horizontal slot 54 permitting access to each of the pair of second substantially vertical belt slots 50.

Figure 3:
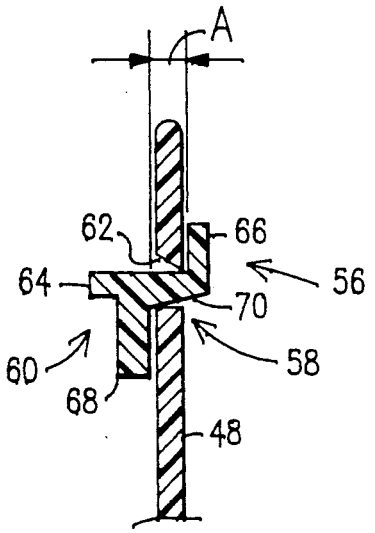
FIG. 3 is a cross-sectional view taken along line 3—3 of FIG. 1.

The beverage container holder 10 further includes a securing means generally indicated as 56 as best shown in FIGS. 1 and 3 to selectively maintain the beverage container holder 10 in a use or erect position as shown in FIGS. 1 and 2. As best shown in FIG. 3, the securing means 56 comprises a first securing element or slot 58 formed on the inner portion 48 of the belt attachment element 42 to selectively receive a portion of a second securing element generally indicated as 60 formed on the substantially annular upper retainer ring 36 to selectively secure the substantially annular upper retainer ring 36 to the belt attachment element 38.

The upper edge or periphery of the slot 58 comprises an inclined surface 62. As shown in FIG. 3, the second securing element 60 comprises a securing element base 64 disposed in co-planar relationship relative to the substantially annular upper retainer ring 36 having an upper and lower second securing element protrusion indicated as 66 and 68 respectively extending outwardly from opposite sides thereof. An inclined surface 70 extends between the upper and lower second securing element protrusion 66 and 68. The distance A between the upper and lower second securing element protrusions 66 and 68 is substantially equal to the thickness of the belt attachment element 42. The length of the lower second securing element protrusion 68 is greater than the length of the upper second securing element protrusion 66.

Since the first and second securing elements 58 and 60 may be selectively disengaged relative to each other, the entire beverage container holder 10 may be stored in a flat position when not in use.

In use, the user simply secures the first and second securing elements 58 and 60 in place relative to each other by passing the upper second securing element protrusion 66 through the slot 58 which allows the user to place the beverage container holder 10 on one's belt (not shown) either through the first or second pair of substantially vertical belt slots. In this configuration, the beverage container (not shown) may be placed through the substantially annular upper retainer ring 32 to rest on the substantially flat, circular lower support base 22 to retain the beverage container (not shown) therein.

Of course, alternatively the attachment member 20 may comprise a clip or hook to couple the beverage container holder 10 to a bicycle frame, car door or the like.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A beverage container holder to retain and support a beverage container therein comprising a single piece body including a lower container support and upper container retainer held in spaced relationship relative to each other by a first and second substantially parallel interconnecting member and an attachment member to attach the beverage container holder to a belt, said attachment member comprising a belt attachment element extending upwardly from the upper portion of said second interconnecting member having a first pair of substantially vertical belt slots formed on the inner portion thereof and a second pair of substantially vertical belt slots in combination with a corresponding horizontal slot permitting access to each of said pair of second substantially vertical belt slots.

2. The beverage container holder of claim 1 wherein said lower container support comprises a substantially flat lower support base having an upwardly extending lip formed about the periphery thereof.

3. The beverage container holder of claim 2 wherein said upper container retainer comprises a substantially annular upper retainer ring.

4. The beverage container holder of claim 1 wherein the lower portion of said first and second substantially parallel interconnecting members are connected to said lower container support by a first and second flexible lower connecting element respectively and first interconnecting member is connected to said upper container retainer by an upper flexible connecting element.

5. The beverage container holder of claim 1 further including a securing means comprising a first securing element formed on said attachment member to selectively receive a portion of a second securing element formed on said upper container retainer to selectively secure said upper container retainer to said attachment member.

6. The beverage container holder of claim 5 wherein said first securing element comprises a slot and said second securing element comprising a securing element base disposed in co-planar relationship relative to said upper container retainer having any upper an lower second securing element protrusion extending outwardly from opposite sides.

7. The beverage container holder of claim 6 wherein the upper edge of said slot comprises an inclined surface.

8. The beverage container holder of claim 5 wherein the length of said lower second securing element protrusion is greater than the length of said upper second securing element protrusion.

9. The beverage container holder of claim 6 further comprising an inclined surface formed on the upper edge of said slot, an inclined surface extending between said upper and lower second securing element protrusion.

10. The beverage container holder of claim 6 wherein an inclined surface extends between said upper and lower second securing element protrusion.

11. The beverage container holder of claim 6 wherein the distance between said upper and said lower second securing element protrusion is substantially equal to the thickness of said attachment member.

12. A beverage container holder to retain and support a beverage container therein comprising a single piece body including a lower container support and upper container retainer held in spaced relationship relative to each other by a first and second substantially parallel interconnecting member, an attachment member to attach the beverage container holder to a belt and a securing means comprising a first securing element formed on said attachment member to selectively receive a portion of a second securing element formed on said upper container retainer to selectively secure said upper container retainer to said attachment member, said first securing element comprising a slot having an inclined surface formed on the upper edge thereof and said second securing element comprising a securing element base disposed in co-planar relationship relative to said upper container retainer having an upper and lower second securing element protrusion extending outwardly from opposite sides.

13. The beverage container holder of claim 12 wherein said lower container support comprises a substantially flat lower support base having an upwardly extending lip formed about the periphery thereof.

14. The beverage container holder of claim 13 wherein said upper container retainer comprises a substantially annular upper retainer ring.

15. The beverage container holder of claim 12 wherein the lower portion of said first and second substantially parallel interconnecting members are connected to said lower container support by a first and second flexible lower connecting element respectively and first interconnecting member is connected to said upper container retainer by an upper flexible connecting element.

16. The beverage container holder of claim 12 wherein said attachment member comprises a belt attachment element extending upwardly from the upper portion of said second interconnecting member having a first pair of substantially vertical belt slots formed on the inner portion thereof.

17. The beverage container holder of claim 16 wherein said belt attachment element further includes a second pair of substantially vertical belt slots in combination with a corresponding horizontal slot permitting access to each of said pair of second substantially vertical belt slots.

18. The beverage container holder of claim 12 wherein an inclined surface extends between said upper and lower second securing element protrusion.

19. The beverage container holder of claim 12 wherein the distance between said upper and said lower second securing element protrusion is substantially equal to the thickness of said attachment member.

20. The beverage container holder of claim 12 wherein the length of said lower second securing element protrusion is greater than the length of said upper second securing element protrusion.

21. A beverage container holder to retain and support a beverage container therein comprising a single piece body including a lower container support and upper container retainer held in spaced relationship relative to each other by a first and second substantially parallel interconnecting member, an attachment member to attach the beverage container holder to a belt, a securing means comprising a first securing element formed on said attachment member to selectively receive a portion of a second securing element formed on said upper container retainer to selectively secure said upper container retainer to said attachment member, said first securing element comprising a slot and said second securing element comprising a securing element base disposed in co-planar relationship relative to said upper container retainer having an upper and lower second securing element protrusion extending outwardly from opposite sides wherein the length of said lower second securing element protrusion is greater than the length of said upper second securing element protrusion.

22. The beverage container holder of claim 21 wherein said lower container support comprises a substantially flat lower support base having an upwardly extending lip formed about the periphery thereof.

23. The beverage container holder of claim 22 wherein said upper container retainer comprises a substantially annular upper retainer ring.

24. The beverage container holder of claim 21 wherein the lower portion of said first and second substantially parallel interconnecting members are connected to said lower container support by a first and second flexible lower connecting element respectively and first interconnecting member is connected to said upper container retainer by an upper flexible connecting element.

25. The beverage container holder of claim 21 wherein said attachment member comprises a belt attachment element extending upwardly from the upper portion of said second interconnecting member having a first pair of substantially vertical belt slots formed on the inner portion thereof.

26. The beverage container holder of claim 25 wherein said belt attachment element further includes a second pair of substantially vertical belt slots in combination with a corresponding horizontal slot permitting access to each of said pair of second substantially vertical belt slots.

27. The beverage container holder of claim 21 wherein the upper edge of said slot comprises an inclined surface.

28. The beverage container holder of claim 21 wherein an inclined surface extends between said upper and lower second securing element protrusion.

29. The beverage container holder of claim 21 wherein the distance between said upper and said lower second securing element protrusion is substantially equal to the thickness of said attachment member.

30. The beverage container holder of claim 21 further comprising an inclined surface formed on the upper edge of said slot, an inclined surface extending between said upper and lower second securing element protrusion.

31. A beverage container holder to retain and support a beverage container therein comprising a single piece body including a lower container support and upper container retainer held in spaced relationship relative to each other by a first and second substantially parallel interconnecting member, an attachment member to attach the beverage container holder to belt, a securing means comprising a first securing element formed on said attachment member to selectively receive a portion of a second securing element formed on said upper container retainer to selectively secure said upper container retainer to said attachment member, said first securing element comprising a slot and said second securing element comprising a securing element base disposed in co-planar relationship relative to said upper container retainer having an upper and lower second securing element protrusion extending outwardly from opposite sides and an inclined surface formed on the upper edge of said slot and an inclined surface extending between said upper and lower second securing element protrusion.

32. The beverage container holder of claim 31 wherein said lower container support comprises a substantially flat lower support base having an upwardly extending lip formed about the periphery thereof.

33. The beverage container holder of claim 32 wherein said upper container retainer comprises a substantially annular upper retainer ring.

34. The beverage container holder of claim 31 wherein the lower portion of said first and second substantially parallel interconnecting members are connected to said lower container support by a first and second flexible lower connecting element respectively and first interconnecting member is connected to said upper container retainer by an upper flexible connecting element.

35. The beverage container holder of claim 31 wherein said attachment member comprises a belt attachment element extending upwardly from the upper portion of said second interconnecting member having a first pair of substantially vertical belt slots formed on the inner portion thereof.

36. The beverage container holder of claim 35 wherein said belt attachment element further includes a second pair of substantially vertical belt slots in combination with a corresponding horizontal slot permitting access to each of said pair of second substantially vertical belt slots.

37. The beverage container holder of claim 31 wherein the distance between said upper and said lower second securing element protrusion is substantially equal to the thickness of said attachment member.

38. The beverage container holder of claim 31 wherein the length of said lower second securing element protrusion is greater than the length of said upper second securing element protrusion.

* * * * *